US010287839B2

(12) United States Patent
Lugtmeier et al.

(10) Patent No.: US 10,287,839 B2
(45) Date of Patent: May 14, 2019

(54) WELLHEAD TIEDOWN SYSTEM

(71) Applicants: Cameron International Corporation, Houston, TX (US); Shell Oil Company, Houston, TX (US)

(72) Inventors: Lubbertus Lugtmeier, Coevorden (NL); Stephan Bjoern Linhart, Hambuerhren (DE); Paul Vasile Marcean, Brasov (RO); Constantin Zanfir, Bergen (DE)

(73) Assignees: Cameron International Corporation, Houston, TX (US); Shell Oil Company, Houston, TX (US)

( * ) Notice: Subject to any disclaimer, the term of this patent is extended or adjusted under 35 U.S.C. 154(b) by 144 days.

(21) Appl. No.: 15/145,623

(22) Filed: May 3, 2016

(65) Prior Publication Data

US 2016/0326824 A1 Nov. 10, 2016

Related U.S. Application Data

(60) Provisional application No. 62/156,747, filed on May 4, 2015.

(51) Int. Cl.
*E21B 33/04* (2006.01)
*E21B 33/00* (2006.01)

(52) U.S. Cl.
CPC ..... *E21B 33/04* (2013.01); *E21B 33/0415* (2013.01); *E21B 2033/005* (2013.01)

(58) Field of Classification Search
CPC ..... E21B 33/03; E21B 33/04; E21B 33/004; E21B 33/00; E21B 33/0415; E21B 2033/005; F16J 15/18; F16J 15/028; Y10S 285/917; Y10T 403/7041
See application file for complete search history.

(56) References Cited

U.S. PATENT DOCUMENTS 4,056,272 A * 11/1977 Morrill ..... E21B 33/04 285/123.13
4,190,270 A 2/1980 Vanderford
4,645,214 A 2/1987 Copley
4,650,225 A 3/1987 Le et al.
4,919,459 A * 4/1990 Miller ..... E21B 33/03 284/140

OTHER PUBLICATIONS

PCT International Search Report & Written Opinion; Application No. PCT/US2016/030803; dated Jul. 18, 2016; 12 pages.

* cited by examiner

*Primary Examiner* — Yong-Suk Ro
(74) *Attorney, Agent, or Firm* — Fletcher Yoder, P.C.

(57) ABSTRACT

A system includes a wellhead tiedown system having a lock screw configured to move axially within an aperture of a spool. The wellhead tiedown system also has a first gland configured to couple to the spool within the aperture and block axial movement of the lock screw in a first direction, and a second gland configured to couple to the lock screw and block axial movement of the lock screw without rotation.

12 Claims, 6 Drawing Sheets

WELLHEAD TIEDOWN SYSTEM

CROSS-REFERENCE TO RELATED APPLICATION

This application claims the benefit of U.S. Provisional Patent Application No. 62/156,747, filed May 4, 2015, entitled "WELLHEAD TIEDOWN SYSTEM," which is incorporated by reference herein in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Hydrocarbon extraction systems use hangers, such as tubing or casing hangers, to suspend tubing and casing in a well. The tubing and casing enables fluid to flow in and out of the well during drilling and/or production. In order to support the hangers within the wellhead, the wellhead uses a spool with lock screws that couple to the hanger.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Hydrocarbon extraction systems may use wellhead tiedown systems to secure hangers, activate seals, etc. The embodiments discussed below illustrate a wellhead tiedown system with first and second glands that secure a lock screw in a wellhead. In operation, the first and second glands provide redundant securing of a lock screw within a wellhead. For example, the first and second glands may interact with separate portions of the lock screw in different ways to secure the lock screw in the wellhead. In some embodiments, the first gland may block removal of the lock screw from the wellhead by engaging a flange on the lock screw. In contrast, the second gland may threadingly couple to the lock screw to block axial movement without rotation.

Figure 1:
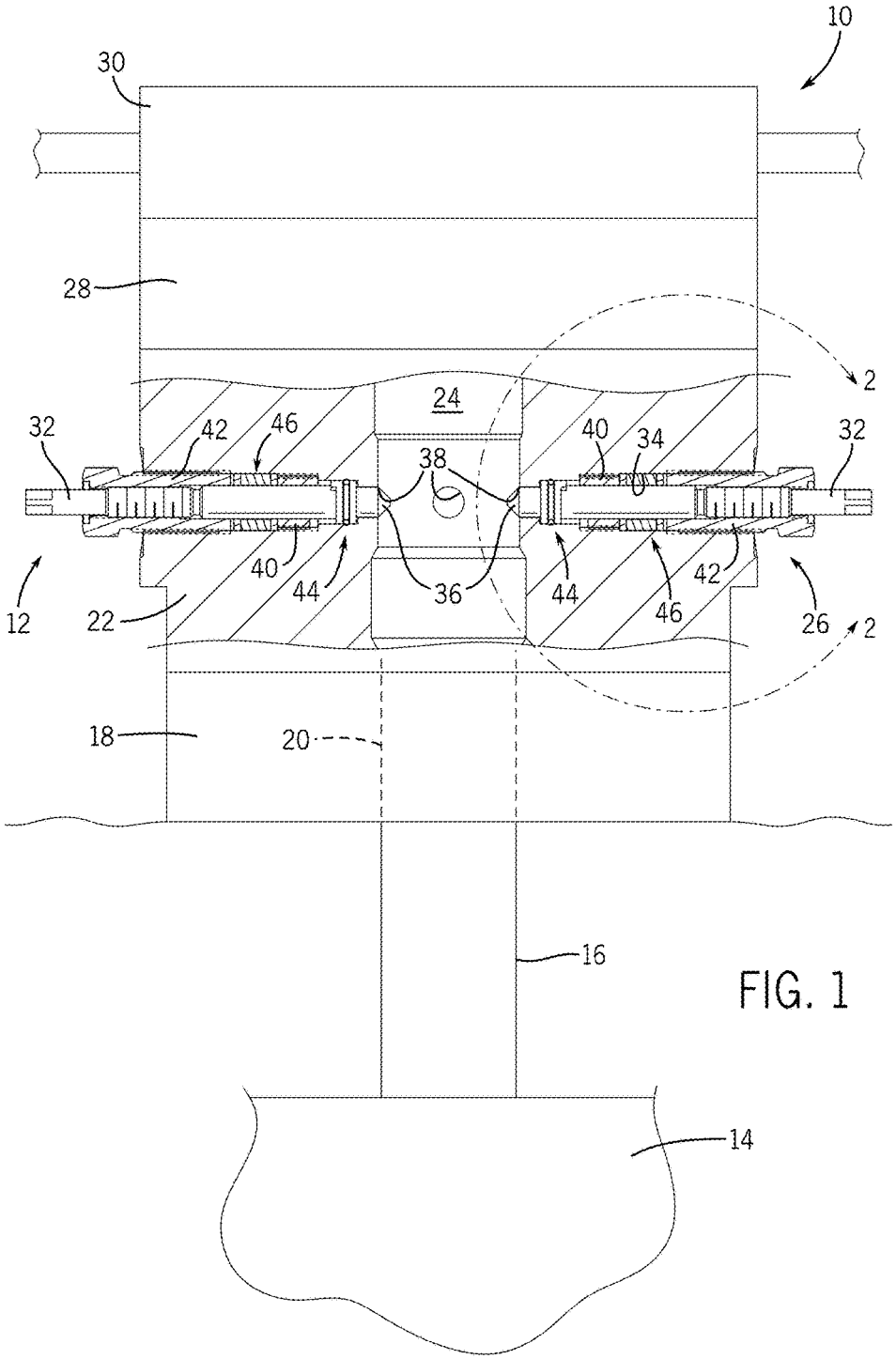
FIG. 1 is a block diagram of an embodiment of a hydrocarbon extraction system with a cross-sectional view of an embodiment of a wellhead tiedown system.

FIG. 1 is a block diagram that illustrates a hydrocarbon extraction system 10 (e.g., mineral extraction system) that extracts hydrocarbons (e.g., oil and/or natural gas) from the earth. The system 10 includes a wellhead 12 coupled to a hydrocarbon deposit 14 via a well 16. The wellhead 12 couples to the well 16 with a wellhead hub 18. The wellhead hub 18 includes a well-bore 20 that enables fluid communication between the well 16 and the rest of the wellhead 12. Coupled to the wellhead hub 18 is a spool 22. The spool 22 supports a hanger 24 with a wellhead tiedown system 26 and enables the hanger 24 to suspend casing or tubing within the well 16 for completion and workover procedures. The wellhead 12 may also include a blowout preventer (BOP) 28 and a Christmas tree 30 that regulate hydrocarbons routed via the wellhead 12. For example, a blowout preventer (BOP) or "Christmas" tree may include a variety of valves, fittings that control the flow of oil, gas, or other fluids through the wellhead 12.

As illustrated, the wellhead tiedown system 26 includes lock screws 32 that extends through apertures 34 and into contact with the hanger 24. For example, the lock screws 28 include tips 36 that engage apertures or recesses 38 in the hanger 24. In order to secure the lock screws 32 in the apertures 34, the wellhead tiedown system 26 includes first glands 40 (e.g., primary gland) and second glands 42. Together the first and second glands 40, 42 increase the steps necessary to remove the wellhead tiedown system 26. The wellhead tiedown system 26 may also include one or more seals such as o-ring seals 44 and packer seals 46. The seals 44 and 46 block fluid from escaping through the apertures 34 while simultaneously blocking dirt and other contaminants from entering the wellhead 12.

Figure 2:
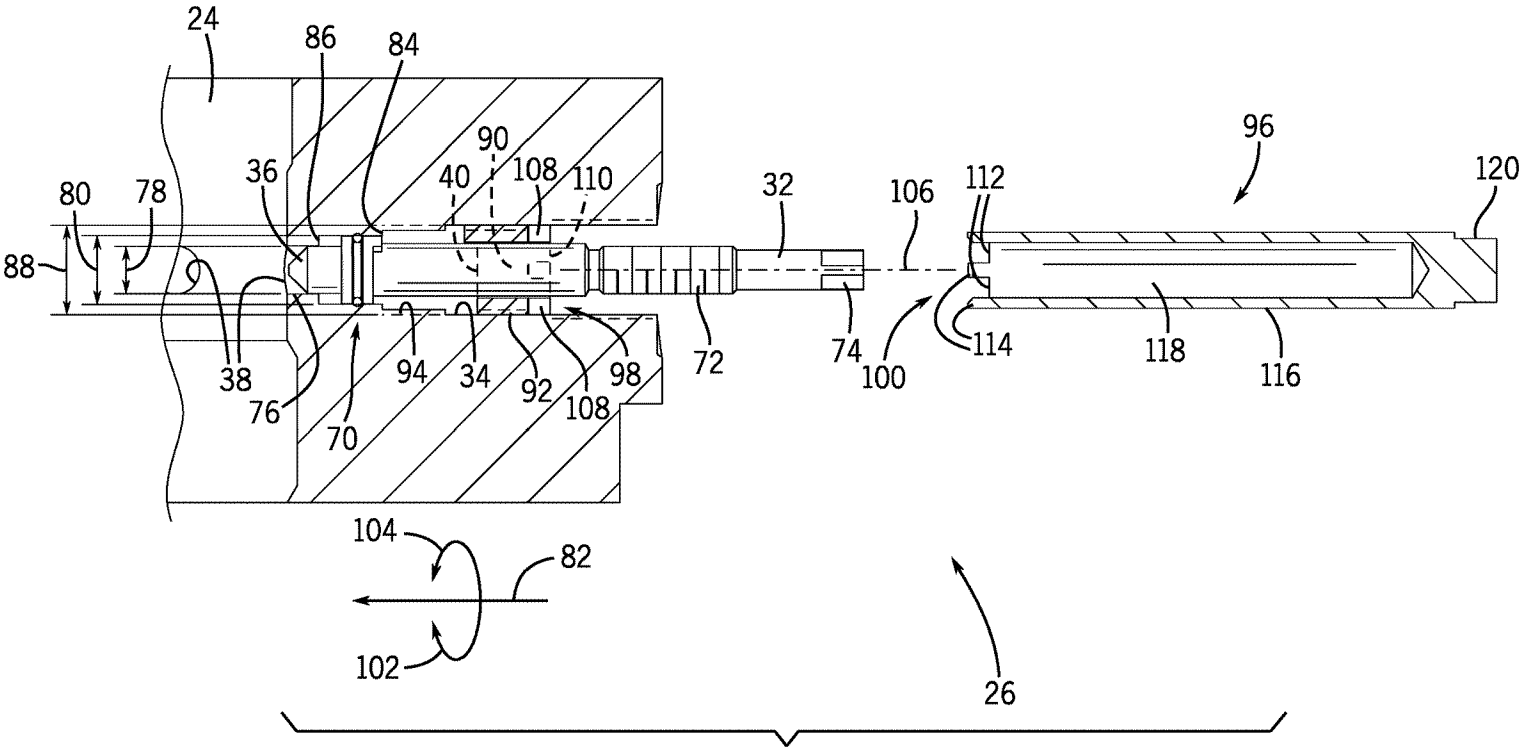
FIG. 2 is a cross-sectional view of an embodiment of a wellhead tiedown system within line 2-2 of FIG. 1.

FIG. 2 is a cross-sectional view of an embodiment of the wellhead tiedown system 26 within line 2-2 of FIG. 1 and in a partially assembled configuration, illustrating the lock screw 32 in the spool 22. As explained above, the lock screw 32 passes through the aperture 34 enabling the tip 36 to engage the recess or aperture 38 in the hanger 24. Axially offset from the tip 36, the lock screw 32 includes a flange 70, a threaded section 72, and a tool contact portion 74. In operation, the flange 70 blocks over-insertion of the lock screw 32 into the aperture 34. For example, the aperture 34 includes an outlet 76 with a diameter 78 that is less than the diameter 80 of the flange 70. Accordingly, as the lock screw 32 moves in axial direction 82, the flange 70 is able to pass through a first counterbore 84 but abuts a second counterbore 86. The second counterbore 86 therefore blocks over-insertion of the lock screw 32 in axial direction 82. As will be explained below, the flange 70 also enables the extraction of the first gland 40.

After inserting the lock screw 32, the first gland 40 is inserted into the aperture 34 around the lock screw 32. As illustrated, the first gland 40 has a diameter 88 and an aperture 90 that enables the first gland 40 to enter the aperture 34 around the lock screw 32. However, the diameter 88 of the first gland 40 is greater than the diameter 80 of the second counterbore 86. Therefore, the first gland 40 is unable to pass through the first counterbore 84 and into the second counterbore 86. The first gland 40 couples to the aperture 34 in the counterbore 84 using threads 92 that engage aperture threads 94.

In order to thread the first gland 40 into the aperture 34, the wellhead tiedown system 26 includes a gland tool 96. The gland tool 96 engages the first gland 40 and threads the first gland 40 into the aperture 34. For example, the first gland 40 includes a first gland connector 98 that enables a tool connector 100 to couple to the first gland 40 and circumferentially rotate the first gland 40 in directions 102 or 104 about an axis 106 of the lock screw 32. The first gland connector 98 may include multiple recesses or slots 108 and protrusions 110 that engage corresponding recesses or slots 112 and protrusions 114 of the tool connector 100. In order to thread the first gland 40 about the lock screw 32, the gland tool 96 includes a body 116 with a cavity 118 that enables the gland tool 96 to slide over the lock screw 32 to engage the first gland 40. In some embodiments, the gland tool 96 may include a tool connector 120, which enables a tool (e.g., wheel, wrench, etc.) to couple to and rotate the gland tool 96.

Figure 3:
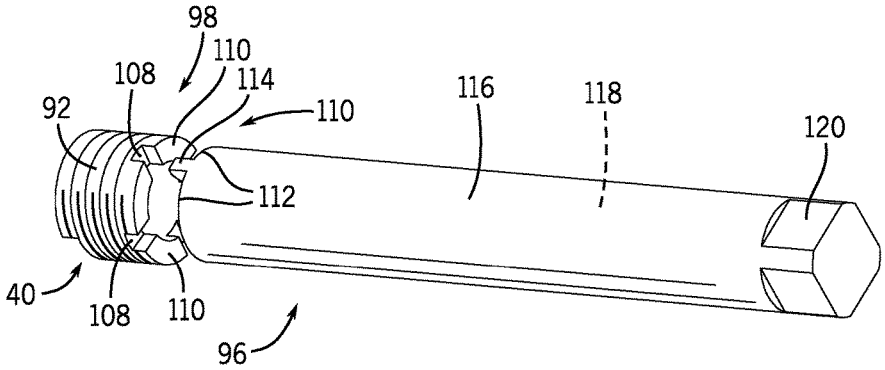
FIG. 3 is a perspective view of an embodiment of a gland and a gland tool.

FIG. 3 is a perspective view of an embodiment of the first gland 40 and the gland tool 96. As explained above, the first gland 40 includes threads 92 that enable the first gland 40 to couple to the spool 22. The first gland 40 also includes the first gland connector 98 that enables the tool connector 100 to couple to and rotate the first gland 40. In some embodiments, the first gland connector 98 may include multiple recesses or slots 108 and protrusions 110 that engage corresponding recesses or slots 112 and protrusions 114 of the tool connector 100. However, other embodiments may include another connector (e.g., pins) that enable the gland tool 96 to couple to and rotate the first gland 40.

Figure 4:
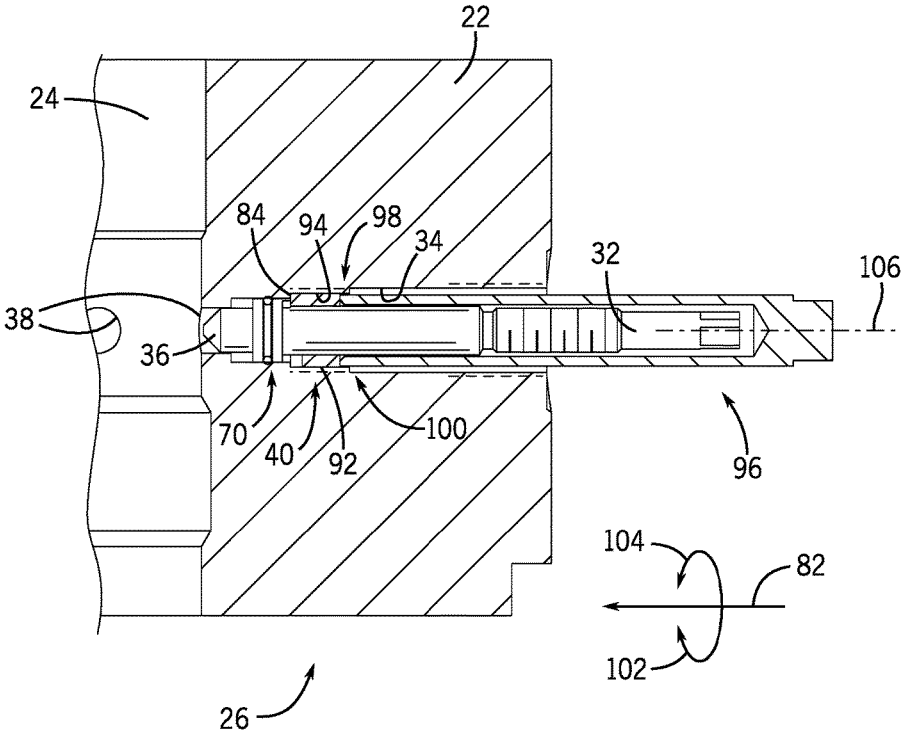
FIG. 4 is a cross-sectional view of an embodiment of a wellhead tiedown system within line 2-2 of FIG. 1.

FIG. 4 is a cross-sectional view of an embodiment of the wellhead tiedown system 26 within line 2-2 of FIG. 1, illustrating the first gland 40 coupled to the aperture 34. As illustrated, the gland tool 96 slides over the lock screw 32 and couples to the first gland 40. The gland tool 96 then circumferentially rotates the first gland 40 in either direction 102 or 104 about the axis 106 of the lock screw 32. As the first gland 40 rotates, the threads 92 on the first gland 40 threadingly engage the threads 94 in the aperture 34 until the first gland 40 contacts the first counterbore 84.

Figure 5:
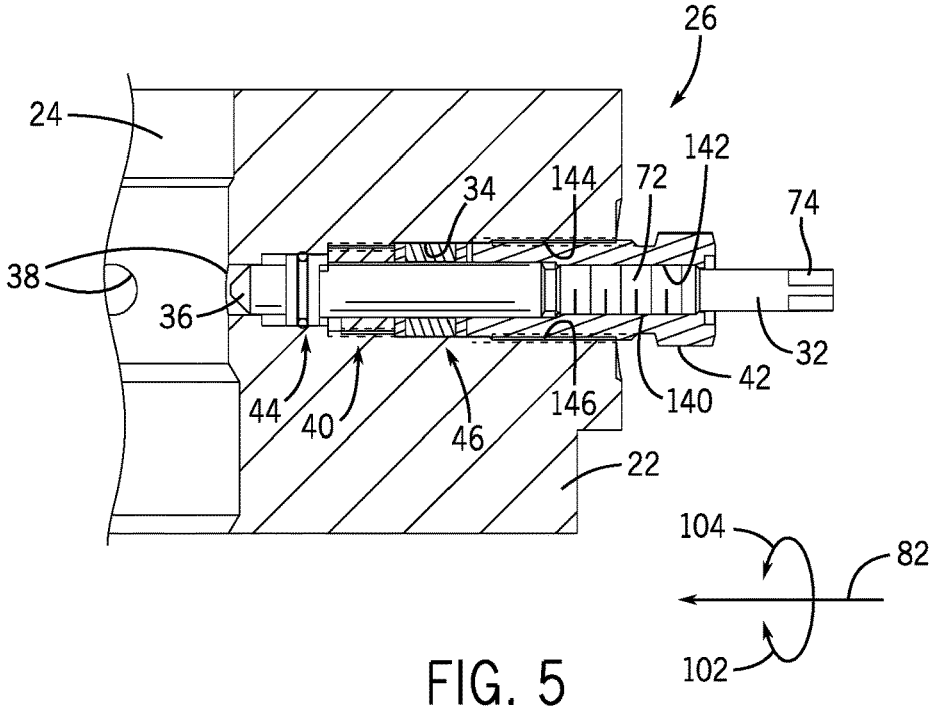
FIG. 5 is a cross-sectional view of an embodiment of a wellhead tiedown system within line 2-2 of FIG. 1.

FIG. 5 is a cross-sectional view of an embodiment of the wellhead tiedown system 26 within line 2-2 of FIG. 1. As illustrated, after coupling the first gland 40 to the aperture 34, the gland tool 96 is removed and the seal 46 (e.g., packer) is inserted into the aperture 34. The wellhead tiedown system 26 then secures the seal 46 and the lock screw 32 within the aperture 34 with the second gland 42. The second gland 42 includes an aperture 140 that enables the second gland 42 to slide over the lock screw 32. Within the aperture 140 are interior threads 142 that enable the second gland 42 to couple to the threads 72 on the lock screw 32. As the second gland 42 threads onto the lock screw 32, the second gland 42 uses exterior threads 144 to couple to the aperture 34. More specifically, the exterior threads 144 on the second gland 42 couple to threads 146 within the aperture 34. Once in place, the first and second glands 40, 42 provide redundant retention of the lock screw 32.

Figure 6:
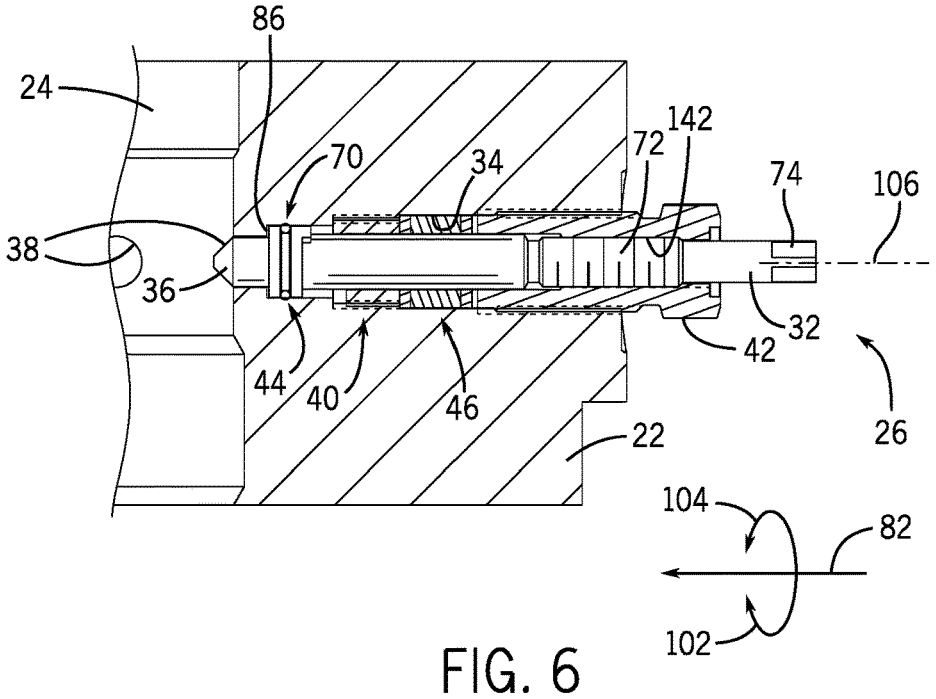
FIG. 6 is a cross-sectional view of an embodiment of a wellhead tiedown system within line 2-2 of FIG. 1.

FIG. 6 is a cross-sectional view of an embodiment of the wellhead tiedown system 26 within line 2-2 of FIG. 1. Once the wellhead tiedown system 26 is securely attached to the spool 22, the lock screw 32 is circumferentially rotated in direction 102 or 104 about the axis 82. As the lock screw 32 rotates, the threads 72 on the lock screw 32 threadingly engage the interior threads 142 of the second gland 42 enabling the lock screw 32 to move in axial direction 82. As the lock screw 32 moves in axial direction 32, the tip 36 engages the recess or aperture 38 on the hanger 24. The lock screw 32 continues to move in axial direction 32 until the flange 70 contacts the second counterbore 86, which blocks further movement in axial direction 82. In this position, the lock screw 32 couples to and suspends the hanger 24 within the spool 22.

Figure 7:
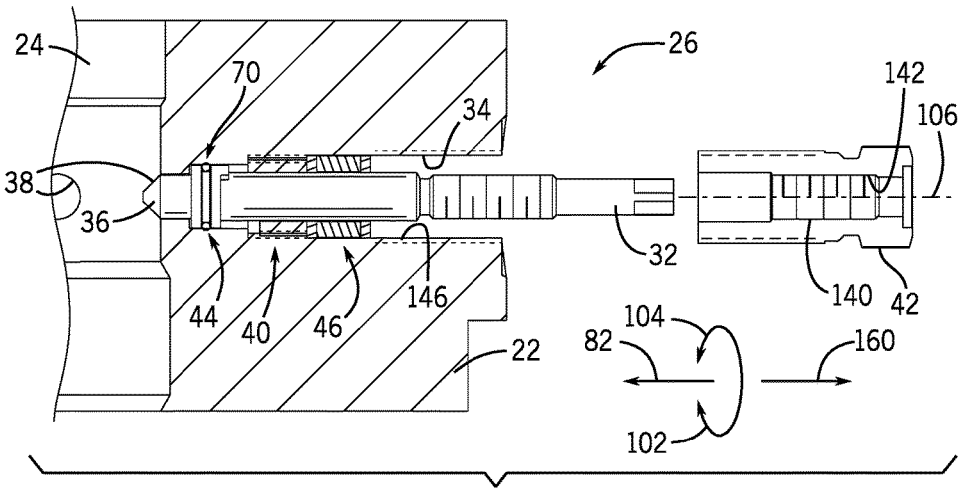
FIG. 7 is a cross-sectional view of an embodiment of a wellhead tiedown system within line 2-2 of FIG. 1.

FIG. 7 is a cross-sectional view of an embodiment of the wellhead tiedown system 26 within line 2-2 of FIG. 1. In order to remove the wellhead tiedown system 26 the second gland 42 is uncoupled from the lock screw 32 and the aperture 34. As explained above, the second gland 42 couples to the lock screw 32 and aperture 34 by rotating in direction 102 or 104 about the axis 106. Accordingly, to remove the second gland 106 from the lock screw 32 and the aperture 34, the second gland 42 is circumferentially rotated in the opposite direction 102 or 104. Once unthreaded, the second gland 42 is removed from the lock screw 32 in axial direction 160.

Figure 8:
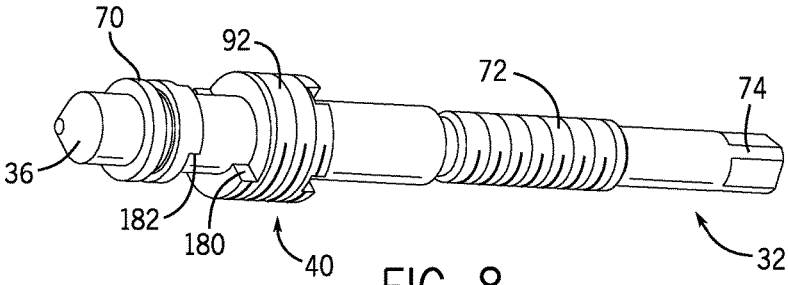
FIG. 8 is a perspective view of an embodiment of a gland and a lock screw.

FIG. 8 is a perspective view of an embodiment of a first gland 40 and a lock screw 32. In order to remove the first gland 40 from the aperture 34, a gland contact face 180 on the first gland 40 is aligned with a flange contact face 182 on the lock screw 32. Once these contact faces 180 and 182 mate, the lock screw 32 unthreads the first gland 40 from the aperture 34 by rotating in direction 102 or 104.

Figure 9:
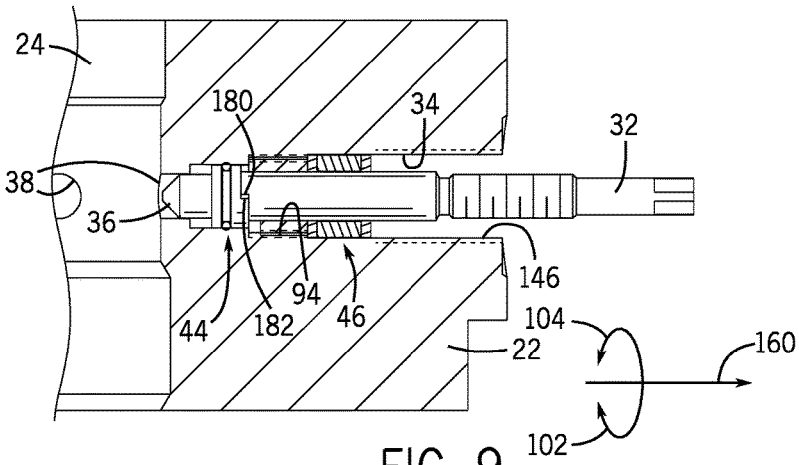
FIG. 9 is a cross-sectional view of an embodiment of a wellhead tiedown system within line 2-2 of FIG. 1.
Figure 10:
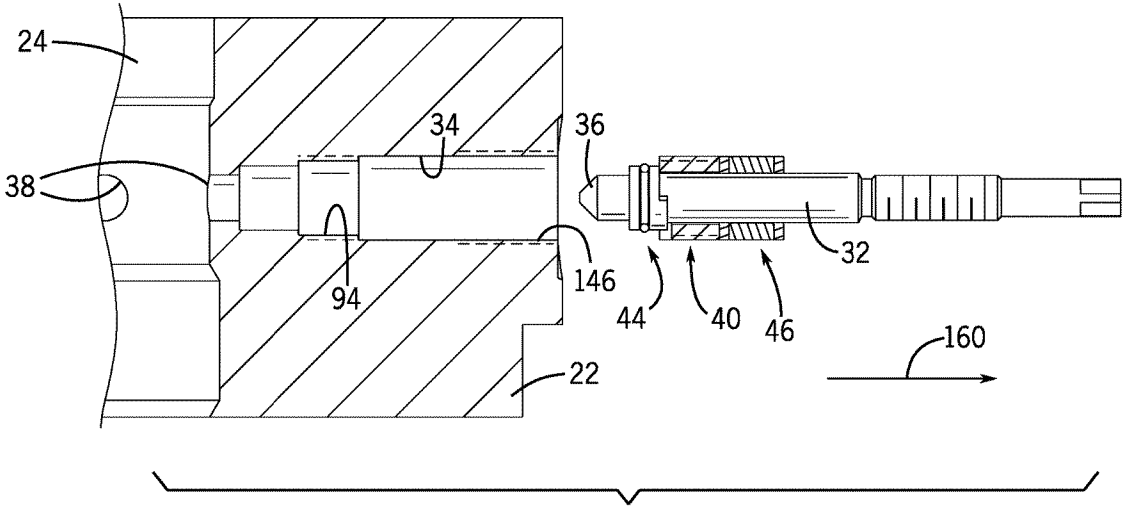
FIG. 10 is a cross-sectional view of an embodiment of a wellhead tiedown system within line 2-2 of FIG. 1.

FIG. 9 is a cross-sectional view of an embodiment of the wellhead tiedown system 26 within line 2-2 of FIG. 1. As illustrated, the lock screw 32 has been pulled in axial direction 160 withdrawing the tip 36 from the recess or aperture 38. Furthermore, the lock screw 32 has been rotated so that the flange contact face 182 aligns with the gland contact face 180. In this position, the lock screw 32 is able to unthread the first gland 40 through contact between the flange contact face 182 and the gland contact face 180. Therefore, as the first gland 40 rotates in direction 102 or 104, the first gland 40 unthreads from the spool 22. After unthreading the first gland 40 from the spool 22, the lock screw 32, seal 46, and first gland 40 are withdrawn together from the aperture 34, as seen in FIG. 10.

Figure 11:
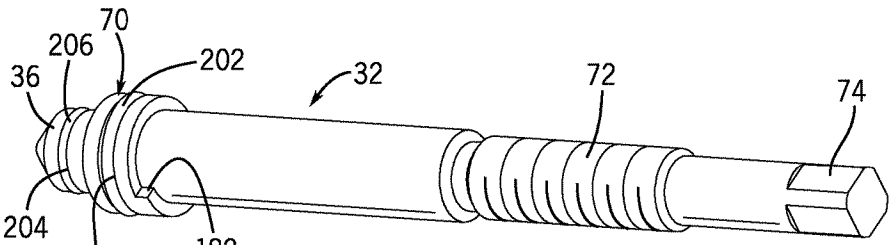
FIG. 11 perspective view of an embodiment of a lock screw.

FIG. 11 perspective view of an embodiment of a lock screw 32. As explained above the lock screw 32 includes a flange 70, a threaded section 72, and a tool contact portion 74. In some embodiments, the wellhead tiedown system 26 uses the flange 70 and/or tip 36 to from the seal 44 with the aperture 34. For example, the flange 70 may include a recess 200 that enables an o-ring to couple to flange 70. Once inserted into the aperture 34 the flange 70 forms the seal 44 with an o-ring 202. In some embodiments, the tip 36 may also include a recess 204 capable of receiving an o-ring 206 that forms the seal 44. In operation, the seal 44 blocks fluid from escaping through the aperture 34 while simultaneously blocking dirt and other contaminants from entering the wellhead 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a wellhead tiedown system, comprising:

a lock screw configured to move axially within an aperture of a spool; and a first gland configured to threadably couple to the spool within the aperture and to block axial movement of the lock screw in one direction along an axial axis by engaging a flange of the lock screw while the first gland is threadably coupled to the spool;

wherein the flange comprises a flange contact face and the first gland comprises a gland contact face, and the flange and gland contact faces enable rotation of the lock screw to drive rotation of the first gland via engagement between the respective contact faces of the lock screw and the first gland to uncouple the first gland from the spool, thereby facilitating removal of the lock screw and the first gland from the aperture of the spool.

2. The system of claim 1, wherein the flange comprises a groove configured to receive an o-ring.

3. The system of claim 1, wherein the lock screw comprises a tip with a groove, and wherein the groove is configured to receive an o-ring.

4. The system of claim 1, comprising a gland tool configured to threadably couple the first gland to the spool, wherein the first gland comprises slots and protrusions that engage corresponding protrusions and slots on the gland tool.

5. The system of claim 4, wherein the gland tool comprises a cavity that enables the gland tool to move axially over the lock screw when threadably coupling the first gland to the spool.

6. The system of claim 1, comprising a hydrocarbon extraction system, wherein the wellhead tiedown system is configured to secure a hanger within the hydrocarbon extraction system.

7. The system of claim 1, comprising a second gland configured to couple to the lock screw and to block axial movement of the lock screw without rotation.

8. A system, comprising:

a hydrocarbon extraction system, comprising:

a spool;

a hanger suspended within the spool; and a wellhead tiedown system configured to secure the hanger within the spool, the wellhead tiedown system, comprising:

a lock screw configured to move axially within an aperture of the spool;

a first gland configured to couple to the spool within the aperture and to block axial movement of the lock screw in one direction along an axial axis of the lock screw; and a second gland configured to threadably couple to the lock screw and to threadably couple to the spool, thereby blocking axial movement of the lock screw without rotation;

wherein the first gland is configured to block the axial movement of the lock screw in the one direction along the axial axis of the lock screw by engaging a flange of the lock screw, the flange comprises a flange contact face and the first gland comprises a gland contact face, and the flange and gland contact faces enable the lock screw to rotate the first gland.

9. The system of claim 8, wherein the flange comprises a groove configured to receive an o-ring.

10. The system of claim 8, comprising a gland tool configured to couple the first gland to the spool, wherein the first gland comprises slots and protrusions that are configured to engage corresponding protrusions and slots on the gland tool.

11. The system of claim 8, comprising packer seals positioned between the first gland and the second gland along the axial axis.

12. The system of claim 8, wherein the lock screw comprises a tip configured to engage a component within the spool, wherein the first gland is configured to be positioned between the tip of the lock screw and the second gland along the axial axis.

* * * * *